US005967419A

United States Patent [19]

Yamaguchi et al.

[11] Patent Number: 5,967,419

[45] Date of Patent: Oct. 19, 1999

[54] INJECTOR IMPROVED IN NOISE REDUCTION

[75] Inventors: Takao Yamaguchi; Yukinori Kato, both of Obu, Japan

[73] Assignee: Aisan Kogyo Kabushiki Kaisha, Obu, Japan

[21] Appl. No.: 09/004,413

[22] Filed: Jan. 8, 1998

[30] Foreign Application Priority Data

Jan. 8, 1997 [JP] Japan ..... 9-001529

[51] Int. Cl.[6] ..... B05B 15/00

[52] U.S. Cl. ..... 239/397.5; 239/585.1; 239/900

[58] Field of Search ..... 239/585.1, 585.2, 239/583, 584, 900, 397.5, 575; 251/129.21, 118; 137/549

[56] References Cited

U.S. PATENT DOCUMENTS

| | | | |
|---|---|---|---|
| 5,190,221 | 3/1993 | Reiter | 239/585.1 |
| 5,224,458 | 7/1993 | Okada et al. . | |
| 5,288,025 | 2/1994 | Cerny | 239/533.8 |
| 5,293,856 | 3/1994 | Press et al. | 123/472 |
| 5,356,079 | 10/1994 | Rahbar | 239/585.1 |
| 5,383,606 | 1/1995 | Stegmaier | 239/575 |
| 5,392,995 | 2/1995 | Wahba | 239/585.1 |
| 5,398,657 | 3/1995 | Press et al. | 239/585.1 |
| 5,580,001 | 12/1996 | Romann et al. | 239/585.4 |
| 5,632,467 | 5/1997 | Just et al. | 251/129.21 |
| 5,732,889 | 3/1998 | Sasao | 239/585.4 |
| 5,769,328 | 6/1998 | Zdyb et al. | 239/585.1 |
| 5,823,446 | 10/1998 | Bennett et al. | 239/585.1 |

FOREIGN PATENT DOCUMENTS

| | | |
|---|---|---|
| 2130257 | 5/1990 | Japan . |
| 7289953 | 11/1995 | Japan . |

*Primary Examiner*—Andres Kashnikow
*Assistant Examiner*—Lisa Ann Douglas
*Attorney, Agent, or Firm*—Dennison, Meserole, Scheiner & Schultz

[57] ABSTRACT

A valve sound emitted from an operated injector is suppressed to be transmitted through a fuel passage in a core to a delivery pipe, thus reducing operating noise. A sound insulating member is fixed in the fuel passage in the core. It has been recognized that transmission of the sound is effectively suppressed even with a sound insulating member of such a size that does not prohibit fuel flow. Preferably, the sound insulating member is integrally assembled to a strainer. Noise from the operated injector is effectively reduced by the invention.

11 Claims, 3 Drawing Sheets

INJECTOR IMPROVED IN NOISE REDUCTION

BACKGROUND OF THE INVENTION

1. Field of the Invention

This invention relates to an injector to be used for supplying fuel to an engine, and more particularly to a technique to reduce operating noise of the injector.

2. Description of the Prior Art

One example of conventional injectors will be described with reference to FIG. 4 which shows a longitudinal sectional view thereof. For convenience, the left side of the injector will be referred to as the front side while the right side thereof will be referred to as the rear side. In FIG. 4, a body 101 is made from magnetic metal, for example, electromagnetic stainless. The front half portion (the left half portion) of a tubular core 102 made from magnetic material is assembled within the rear half portion (the right half portion) of the body 101. A bobbin 104 on which a solenoid coil 105 is wound in multi-layers is disposed in an annular space between the body 101 and the core 102. A connector 107 is formed by resin molding so as to cover substantially central portion of the core 102. The connector 107 is connected to a supply connector extending from an electronic controller (not shown).

Within the front end portion (the left end portion) of the body 101, a valve seat 108 having a fuel jet hole 109 is incorporated together with an adapter 110. Within the valve seat 108, a valve 112 is accommodated to be axially slidable. A C-shaped plate-like stopper 111 is interposed between the valve seat 108 and a step portion 101*b* of the body 101. An O-ring 119 is fitted to an annular recess in the outer periphery of the valve seat 108. The valve seat 108 is secured by caulking the front edge 101*a* of the body 101 to the adapter 110.

An armature 113 made from magnetic metal is fixed to the rear end (the right end) of the valve 112. The armature 113 is attracted to the core 102 when the solenoid coil 105 is energized. Inside the core 102, a pipe 114 is fixed by press fitting. A valve spring 115 is assembled between the pipe 114 and the valve 112. The valve 112 is normally biased by an elastic force of the valve spring 115 to close the fuel jet hole 109 of the valve seat 108. Thus, a fuel passage 116 is formed from a hollow space within the core 102 to the fuel jet hole 109 of the valve seat 108.

A strainer 117 is inserted into the rear end portion of the core 102 corresponding to an inlet of the fuel passage 116. The strainer 117 is formed of a net member 117*a* that is insert-molded into a stopper 117*b*. The strainer 117 is assembled by pressingly fitting the stopper 117*b* into the core 102. An O-ring 120 is fitted around an annular recess (not numbered) formed in the outer periphery of the core 102 near the rear end thereof. The rear end portion of the core 102 is fixedly received at a mounting port of a delivery pipe (not shown).

The operation of the above injector will be summarized below. Fuel supplied from a fuel tank (not shown) in a predetermined pressurized state flows from the delivery pipe into the rear portion of the core 102 through the fuel passage 116 into the interior of the valve seat 108. Normally, the valve 112 is maintained to close the fuel jet hole 109 of the valve seat 108 by the elastic force of the valve spring 115, so that fuel injection does not occur.

Under the above state, when the solenoid coil 105 is energized by input of an electric signal from the electronic controller, the armature 113 is retreated by the attraction force of the core 102. As a result, the fuel jet hole 109 of the valve seat 108 is opened by the valve 112, thus injecting the fuel.

When the electric signal to the solenoid coil 105 becomes off to remove the attraction force of the core 102 which has been acting on the armature 113, the valve 112 closes the fuel jet hole 109 again by the elastic force of the valve spring 115, thus resulting in stop of the fuel injection.

A conventional fuel injector other than above is disclosed, for example, in Japanese Laid-Open Patent Application No. 7-28995.

In the prior arts, operation of the above injector generates metal colliding sound when the valve 112 is retreated to abut the stopper 111 by the energization of the solenoid coil 105 and when the valve 112 is advanced to abut the valve seat 108 by stop of the energization thereof. The metal colliding sound is transmitted through the fuel passage 116 in the core 102 to the delivery pipe and emitted to the outside as a noise.

SUMMARY OF THE INVENTION

Accordingly, an object of the present invention is to provide an injector in which operating noise is reduced.

Another object of the invention is to suppress such a phenomenon that metal colliding sound of a valve is transmitted through a fuel passage to a delivery pipe.

In the present invention, in order to attain the objects, a sound insulator is provided in the fuel passage between the valve and an inlet of the fuel passage. When a cross-sectional area of the sound insulator is suitably selected, transmission of the metal colliding sound can be effectively suppressed without hindering fuel flow.

In one aspect of the invention, Sx/S is set as follows, where Sx is a cross sectional area of the sound insulator and S is a cross sectional area of a hollow space of the core at a position where the sound insulator is located.

$$0.72 \leqq S_x/S \leqq 0.89$$

In the above range, transmission of the valve operating sound is effectively suppressed without conspicuous degradation of fuel flow performance.

The present invention will be more fully understood from the following detailed description and appended claims when taken with the accompanying drawings.

DETAILED DESCRIPTION OF THE PREFERRED EMBODIMENT

Figure 1:
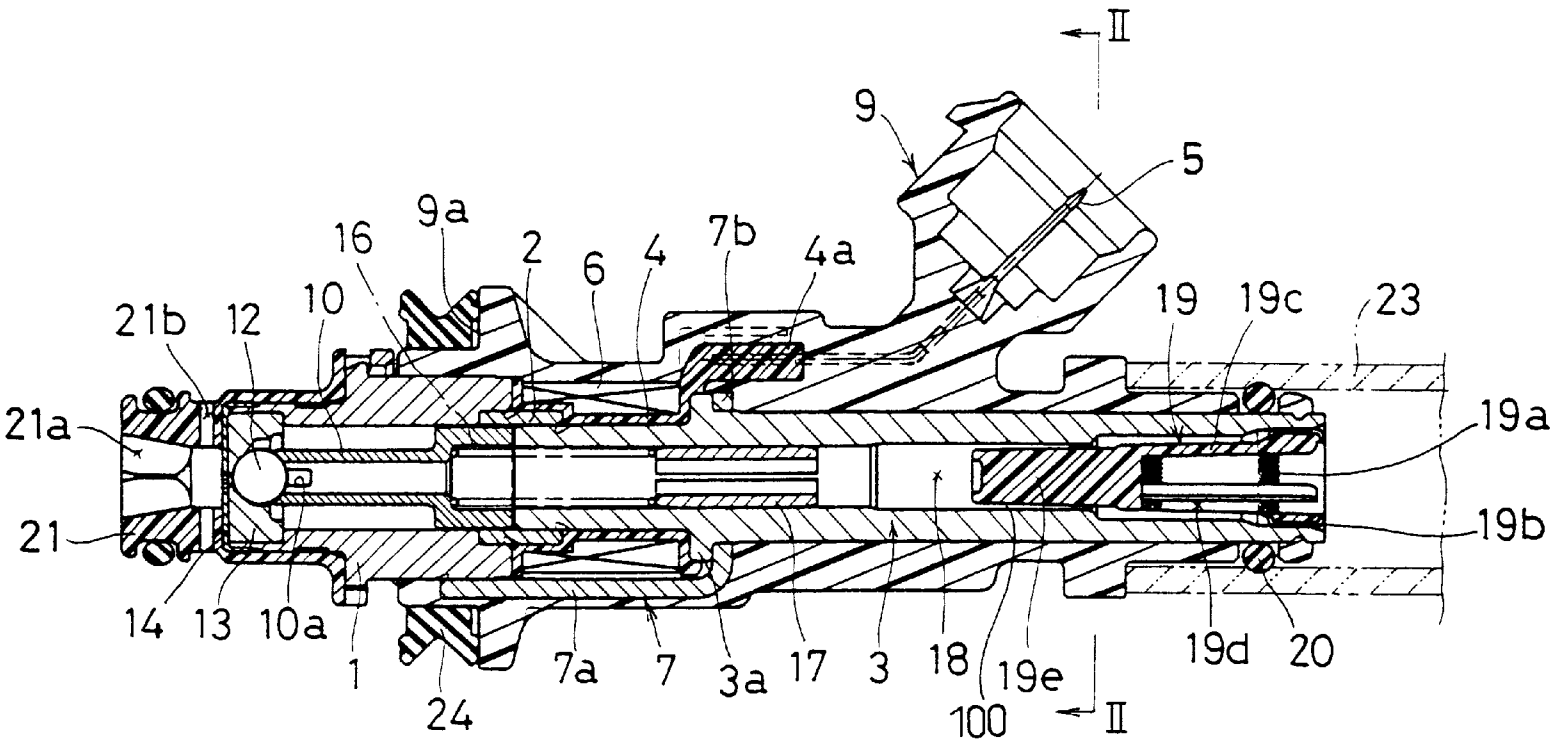
FIG. 1 is a longitudinal sectional view of an injector according to an embodiment of the present invention.

A preferred embodiment of a fuel injector according to the present invention will now be described with reference to the drawings. FIG. 1 is a longitudinal sectional view of an injector used in a vehicle engine. For convenience, in FIG. 1, the left side of the injector will be referred to as the front side while the right side thereof will be referred to as the rear side. Summary of the injector will first be described, and then the essential construction thereof will be described.

In FIG. 1, a body 1 of the fuel injector made from magnetic material is formed into a tubular shape. A non-magnetic ring 2 is welded to the rear end of the body 1 after press fitting. The front end portion of a magnetic tubular core 3 is welded to the rear half portion of the ring 2 after press fitting. A flange-like projection 3*a* is formed on the peripheral surface of the core 3. The body 1 is provided with an upper body 7 (described herein after) as an integral part and is therefore referred to also as a lower body.

Around the ring 2 and the core 3 between the lower body 1 and the projection 3*a* of the core 3, a bobbin 4 made from synthetic resin or like electrically insulating materials is formed by resin molding. A solenoid coil 6 is wound on the bobbin 4. The bobbin 4 is provided with a terminal connecting portion 4*a* into which a connecting end of a terminal 5 is press-fitted. The connecting end of the terminal 5 is electrically connected to the solenoid coil 6.

The outer periphery of the solenoid coil 6 is partly surrounded by the magnetic upper body 7. The upper body 7 includes an end plate 7*b* with a mounting hole (not numbered) and a pair of cover plates 7*a* (one of two is shown in FIG. 1) each having an arcuate cross-section and extending toward the front side from a peripheral edge of the end plate portion 7*b*. The end plate 7*b* has the core 3 press-fitted into the mounting hole (not numbered) and is in contact with the projection 3*a*. The lower body 1 is welded to the front end portions of the cover plates 7*a* after press fitting.

The periphery from the half end portion of the lower body 1 to the rear end portion of the core 3 is covered with resin by molding. A connector 9 of the terminal 5 is integrally formed by this resin molding. The connector 9 is connected to a supply connector from an electronic controller (not shown). Energization and stop of energization of the solenoid coil 6 are performed by the electrical controller.

An armature 10 to be attracted to the core 3 during the energization of the solenoid coil 6 is made from magnetic metal and has a hollow cylindrical shape. The armature 10 has a globular valve 12 at its front end. A hollow space of the armature 10 constitutes a fuel passage. At the front end of the armature 10, a cut recess 10*a* is formed as an outlet of the fuel passage.

A valve seat 13 having a jet hole (not numbered) is inserted and secured into the front end of the lower body 1. The jet hole of the valve seat 13 is opened and closed as the valve 12 moves in association with axial sliding movement of the armature 10. When the valve 12 is retreated, the front end surface of the core 3 comes in contact with the rear end surface of the armature 10 to thereby determine the retreat position of the valve 12. On the front surface of the valve seat 13, an orifice plate 14 is mounted by laser welding. The orifice plate 14 is a circular plate member including a plurality of orifices (not numbered).

A resin adapter 21 is fitted to the lower body 1 to cover the valve seat 13. The adapter 21 includes jet ports 21*a* and air supply holes 21*b* for supplying assist air.

Within the core 3, a valve spring 16 is inserted and then a spring pin 17 is press-fitted. The valve spring 16 is made from spring steel, and the spring pin 17 of a C-shaped cross section is made from pipe material with a vertical groove thereon. The valve spring 16 normally biases the armature 10 in a closing direction of the valve 12.

A follow space of the core 3 constitutes a fuel passage 18 communicating with a fuel passage in the armature 10. A strainer 19 is press-fitted into the rear end portion of the core 3 corresponding to an inlet of the fuel passage 18. An annular recess (not numbered) is formed at the rear end of the outer periphery of the core 3 simultaneously when the connector 9 is resin molded. An O-ring 20 is fitted to the annular recess. The rear end portion of the core 3 is inserted into a mounting port of a delivery pipe 23 (see two dot and chain line in FIG. 1).

The connector 9 has at its front end a step portion 9*a* to which an insulator 24 is fitted for sealing. The insulator 24 an intake manifold and the connector 9 when the front end of the fuel injector is inserted into an injector-mounting hole of the intake manifold.

The operation of the injector will be described below. Fuel supplied from a fuel tank (not shown) under a predetermined pressure is filtered by the strainer 19 and then conveyed from the fuel passage 18 in the core 3 through the fuel passage in the armature 10 and the cut recess 10*a* into the interior of the valve seat 13. Normally, the valve 12 is maintained to close the jet hole of the valve seat 13 by an elastic force of the valve spring 16, thus preventing fuel injection.

When the solenoid coil 6 is energized by input of an electric signal from the electronic controller, the armature 10 is retreated by the attraction force of the core 3. Consequently, the valve 12 opens the jet hole of the valve seat 13, thus injecting fuel. When the electric signal to the solenoid coil 6 is cut off, the attractive force of the core 3 which has been acting on the armature 10 is removed. Thus, the elastic force of the valve spring 16 causes the valve 12 to close the jet hole again so that the fuel injection is stopped.

The essential part of the injector will now be described. The embodiment employs the above-described strainer 19. As shown in FIG. 1, the cylindrical strainer 19 with a bottom includes a synthetic resin cover 19*c* with an opening groove 19*d* on its cylindrical portion, and a net member 19*a* and a stopper 19*b* each being insert-molded into the cover 19*c*. The strainer 19 is fixed into the core 3 by press-fitting the stopper 19*b* into the core 3. The fuel flows from the inside of the strainer 19, through the net member 19*a* and the opening groove 19*d* of the cover 19*c*, and into the fuel passage 18 of the core 3.

Figure 2:
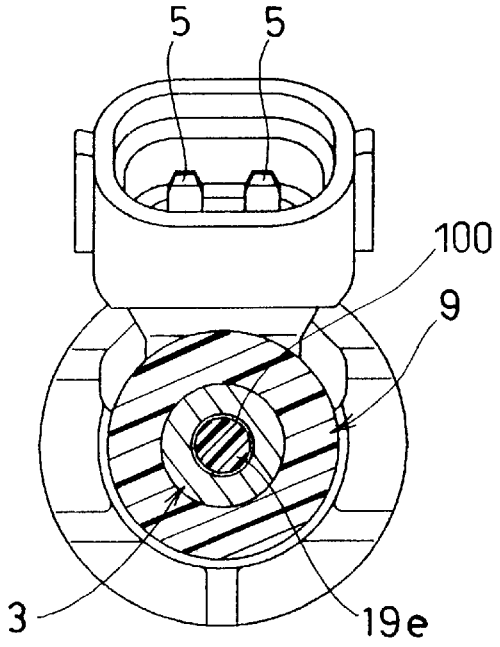
FIG. 2 is a cross-sectional view taken along line II—II of FIG. 1.

The bottom surface of the cover 19*c* is formed into a sound insulator 19*e*. The sound insulator 19*e* has a cylindrical shape and extends coaxially with the core 3. The sound insulator 19*e* is positioned at the axial center of the fuel passage 18. Therefore, an actual flow path corresponds to an annular hollow space 100 formed between the sound insulator 19*e* and the core 3. The sound insulator 19*e* is tapered so as to gradually reduce the diameter toward the front end thereof. FIG. 2 is a cross-sectional view taken along line II—II of FIG. 1.

In the injector with the above-described strainer 19, an operating sound is generated by on and off operation of the solenoid coil 6. This is a metallic sound generated when the retreated armature 10 collides with the core 3 and when the advanced valve 12 collides with the valve seat 13. The metallic sound is transmitted through the fuel passage 18 of the core 3 to the delivery pipe 23. However, the sound insulator 19*e* disposed in the fuel passage 18 of the core 3 prevents the operating sound of the valve 12 from being transmitted to the delivery pipe 23, thus effectively suppressing emission of the operating sound of the valve 12 through the delivery pipe 23 to the outside. Eventually, operating noise of the injector can be reduced.

The area ratio obtained by Sx/S is rendered to be R, where Sx is a cross sectional area of the sound insulator 19*e* and S is a cross sectional area of a hollow space of the core 3 respectively at a position where the cross sectional area of the fuel path 100 is smallest (a position of line II—II in FIG. 1). (In this case, the cross sectional area of the fuel path 100 is S-Sx.)

Figure 3:
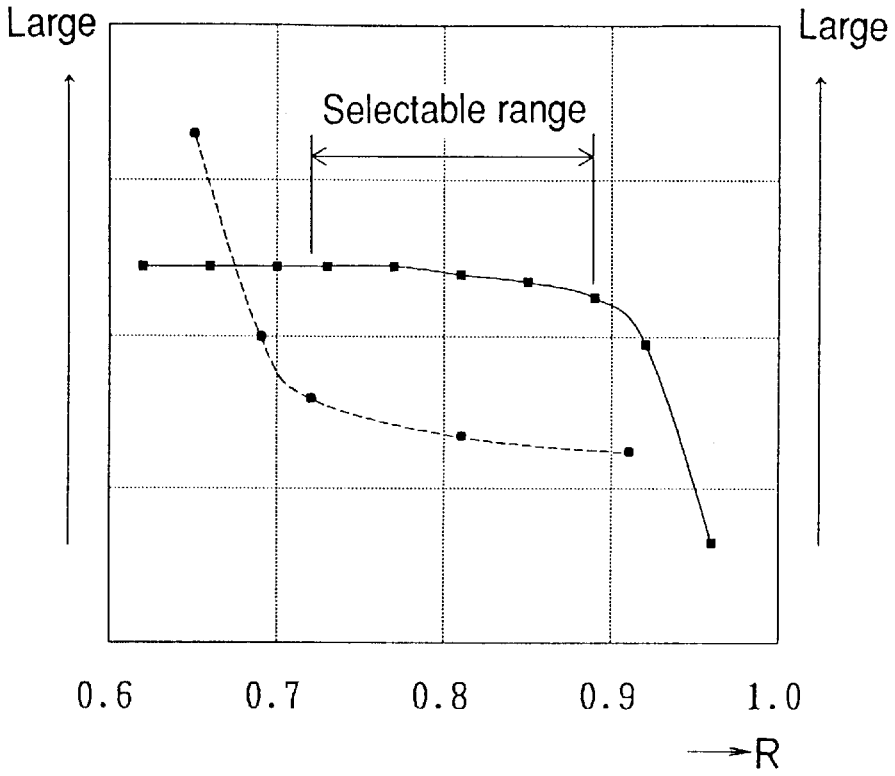
FIG. 3 is a graph showing a selectable range of area ratio of an sound insulator to a hollow space of a core.
Figure 4:
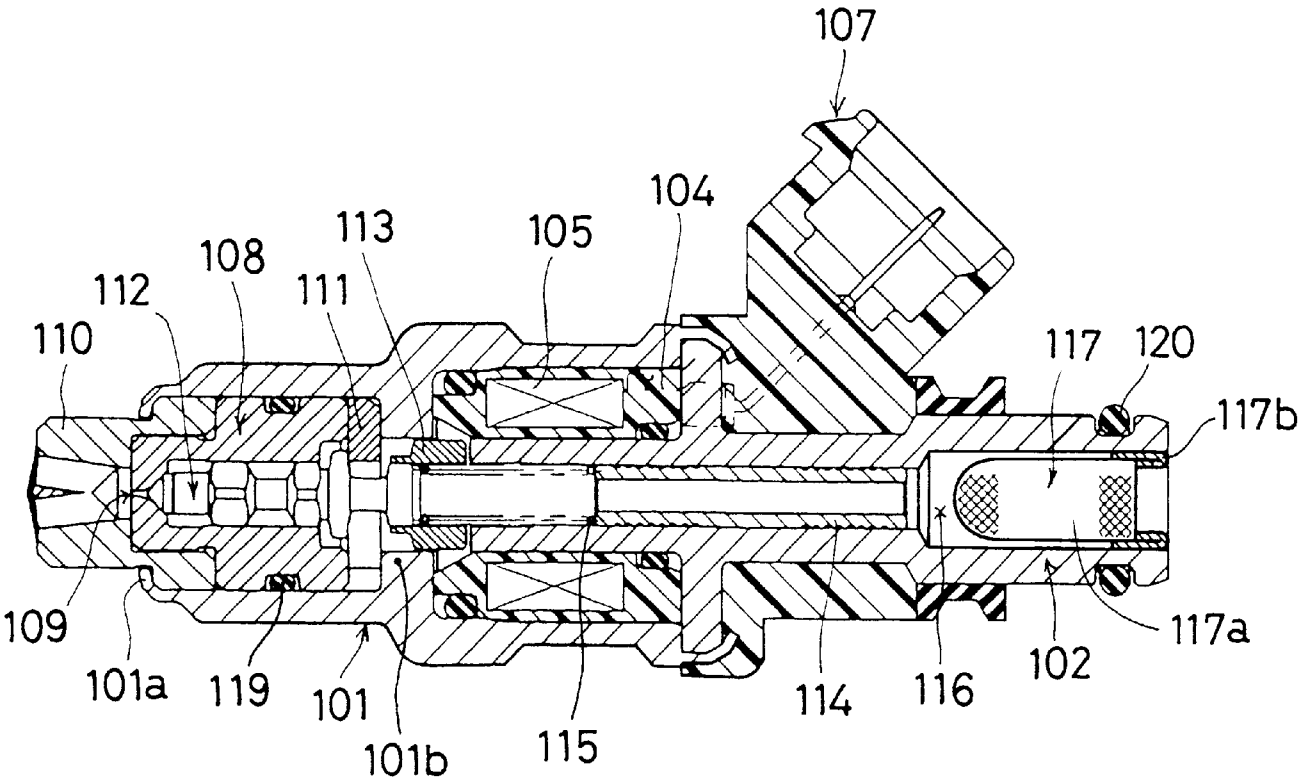
FIG.4 PRIOR ART
FIG. 4 is a longitudinal sectional view of an injector according to a prior art.

FIG. 3 is a graph showing a measured result of fuel flow rate and sound pressure (more precisely, noise pressure emitted through the delivery pipe 23 to the outside) corresponding to variation of the area ratio R. The abscissa shows the area ratio R, the right ordinate shows fuel flow rate, and the left ordinate shows sound pressure, respectively. A solid line shows the plots of measured fuel flow and a dot line shows the plots of measured sound pressure. It is understood from this graph that a desired fuel flow rate (solid line in FIG. 3) can be ensured without generating passing resistance where the area ratio R is below 0.89. Further, it is understood that sound pressure (dot line in FIG. 3) can effectively be reduced where the area ratio R exceeds 0.72.

Accordingly, it is possible not only to dispose the sound insulator 19*e* at the central axial portion of the fuel passage 18 in the core 3 without conspicuous degradation of the fuel flow performance but also to effectively prevent operating sound of the valve 12 from being transmitted to the delivery pipe 23 where area ratio R is within a range shown by a relation $0.72 \leqq R \leqq 0.89$.

Further, the strainer 19 is integrally formed with the sound insulator 19*e*, the sound insulator 19*e* can be arranged in the fuel passage 18 of the core 3 simultaneously when the strainer 19 is inserted into the core 3, thus resulting in reduction of the parts number and assembling steps when compared with the case when the strainer 19 and the sound insulator 19*e* are separately assembled.

The present invention is not limited to the above-described embodiment, and any modifications or variations may be easily made without departing from the scope of the invention. For example, the sound insulator 19*e* of the cover 19*c* can be formed into a straight shape or into a shape reversely tapered so as to gradually increase the diameter toward the front end, as long as sound transmission can be avoided. Further, the sound insulator 19*e* can be provided in the core 3 separately from the cover 19*c* by supporting it via a support member.

Thus, the injector of the present invention prevents the valve-operating sound in the fuel passage of the core from being transmitted to the delivery pipe, thus reducing noise emission to the outside.

While the invention has been described with reference to preferred embodiments thereof, it is to be understood that modifications or variations may be easily made without departing from the scope of the present invention which is defined by the appended claims.

What is claimed is:

1. An injector comprising:

a magnetic tubular core having therein a hollow space constituting a fuel passage;

an armature moved toward and moved away from said core by an electromagnetic force;

a valve for opening and closing said fuel passage in association with said armature;

a sound insulating member disposed coaxially with said fuel passage, where $S_x$ is a cross-sectional area of said sound insulating member, S is a cross-sectional area of the hollow space of said core where the insulating member is located and the sound insulating member cross-sectional area is determined so that the relation $0.72 \leqq S_x/S \leqq 0.89$ holds.

2. The injector as defined in claim 1, further including a strainer, said sound insulating member being fixed to the strainer.

3. A fuel injector, comprising:

a magnetic tubular body having a fuel passage disposed within the magnetic tubular body, the fuel passage having an inlet at a first end of the magnetic tubular body;

an armature comprising a magnetic material and disposed at a second end of the magnetic tubular body, the armature being movable in response to an electromagnetic force;

a valve that operates in response to movement of the armature; and a sound insulator disposed within the fuel passage between the valve and the fuel passage inlet, said sound insulator having a cross-sectional area ratio relative to the fuel passage between 0.72 and 0.89 at a location in which the sound insulator is disposed within the fuel passage.

4. The fuel injector as defined in claim 3 wherein the sound insulator is reverse tapered, such that the diameter of the sound insulator gradually increases in a direction away from the fuel passage inlet.

5. The fuel injector as defined in claim 3 wherein the sound insulator is tapered.

6. The fuel injector as defined in claim 5 further comprising a strainer fixed to the sound insulator.

7. The fuel injector as defined in claim 6 further comprising a solenoid disposed coaxially around the magnetic tubular body, the solenoid generating the electromagnetic force that controls movement of the armature.

8. The fuel injector as defined in claim 7 wherein the armature comprises a fuel passage and wherein the valve opens and closes in association with axial sliding movement of the armature.

9. The fuel injector as defined in claim 8 wherein the valve is a globular valve.

10. The fuel injector as defined in claim 3 wherein the sound insulator is cylinder shaped.

11. A fuel injector comprising:

a magnetic tubular core having therein a hollow space constituting a fuel passage, said hollow space having a cross-sectional area S;

an armature moved toward and moved away from said core by an electromagnetic force;

a valve for opening and closing said fuel passage in association with said armature; and a sound insulating member having a cross-sectional area $S_x$ disposed coaxially with said fuel passage to form an annular space for an actual fuel flow path between the core and the sound insulating member, said annular space having a cross-sectional area $S-S_x$ and this cross-sectional area being determined so that $S_x/S$ falls within the range of 0.72 to 0.89.

* * * * *